United States Patent [19]

Kuru

[11] 4,367,944

[45] Jan. 11, 1983

[54] CHARGING POTENTIAL CONTROL MEANS FOR ELECTROPHOTOGRAPHIC COPIERS

[75] Inventor: Hiroshi Kuru, Hachioji, Japan

[73] Assignee: Konishiroku Photo Industry Co., Ltd., Tokyo, Japan

[21] Appl. No.: 234,410

[22] Filed: Feb. 13, 1981

[30] Foreign Application Priority Data

Feb. 19, 1980 [JP] Japan ..... 55-20497[U]

[51] Int. Cl.[3] ..... G03G 15/00; G03G 15/02

[52] U.S. Cl. ..... 355/14 CH; 355/3 CH; 355/6

[58] Field of Search ..... 355/14 R, 14 CH, 3 CH, 355/6, 112, 133

[56] References Cited

U.S. PATENT DOCUMENTS 2,890,343 6/1959 Bolton ..... 355/6 X 3,944,354 3/1976 Benwood et al. ..... 355/14 R 3,951,541 4/1976 Kuehnle ..... 355/14 CH 4,105,321 8/1978 Urso ..... 355/3 CH 4,312,589 1/1982 Brannan et al. ..... 355/3 CH

*Primary Examiner*—R. L. Moses

*Attorney, Agent, or Firm*—Jordan B. Bierman; Linda Bierman

[57] ABSTRACT

In a copying apparatus having a photosensitive member such as a drum, good reproductivity and image density results from applying a proper charging potential to the photosensitive substance on the drum. The optimum charging potential for each drum can be predetermined and a code or indicia representative of such optimum potential may be attached or otherwise appended to the drum. This code is read by a suitable sensor which in turn controls the charging potential applied to the drum.

3 Claims, 8 Drawing Figures

CHARGING POTENTIAL CONTROL MEANS FOR ELECTROPHOTOGRAPHIC COPIERS

BACKGROUND OF THE INVENTION

The present invention relates to copying apparatus utilizing a photosensitive member which has a photoconductive layer for forming electrostatic latent images.

Generally speaking in copying apparatus utilizing a system for forming electrostatic latent images, an electric charge is uniformly made, in the dark or with exposure to light, on a photosensitive member having a photoconductive layer coated on an electric conductive base, or having a transparent insulating layer coated on the photoconductive layer, on whose surface an electric potential is generated. An area of the thus generated surface electric potential is removed by making use of any one of the methods which are already publicly known, such as the imagewise exposure method, and thereby an electrostatic latent image is formed. The electrostatic latent image is made visible by already known methods using toner or developer; the image density of the visible image is dependent on the surface electric potentials of a photosensitive substance which forms electrostatic latent images. In this connection, in copying apparatus utilizing any one of the known systems for forming electrostatic latent images, it is always desirable for obtaining good copy images to provide satisfactory fixed surface electric potentials on the photosensitive substance to be used, in accordance with the characteristic of the electric charge thereof.

However, copying itself can be achieved only by the proper correlative operations of both process measures and photosensitive substance. Additionally, those photosensitive substances will have a scattering of characteristics of the electric charge in every lot of manufacture or in every individual cause, more particularly with a Se photosensitive substance. Therefore to obtain fine copy images having a proper density reproductivity, one must adjust the copying apparatus so as to maintain the best suitable conditions for the electric charge on the photosensitive substance. Normally, to make an adjustment of the characteristics of electric charge on an individual photosensitive substance, such as the adjustment of electric current for electric charging, it is necessary to use a measuring apparatus such as an ampere meter. Moreover such adjustments are often incorrect with the dangers arising therewith, because such adjustments deal with high tension voltages about 4–6 kilovolt. Furthermore; the adjustment takes much time.

SUMMARY OF THE INVENTION

In consideration of the above mentioned points, an object of the present invention is to provide a copying apparatus that solves the complexity, incorrectness and inefficiency of electric current adjustments for electric charging; that is it provides an indicator displaying the most suitable conditions of electrically charging for each photosensitive substance, on the side of the photosensitive member; that is it equips the copying apparatus side with a device for reading said displays; it also provides the most suitable surface electric potential with a good image reproductivity on the photosensitive member by a charging electrode or device in accordance with a signal output generated by said display.

The present invention is illustrated by the following examples with reference to the drawings:

BRIEF DESCRIPTION OF THE DRAWINGS

The drawings illustrate an example of the present invention, of which

DETAILED DESCRIPTION OF THE PREFERRED EMBODIMENTS

Figure 1:
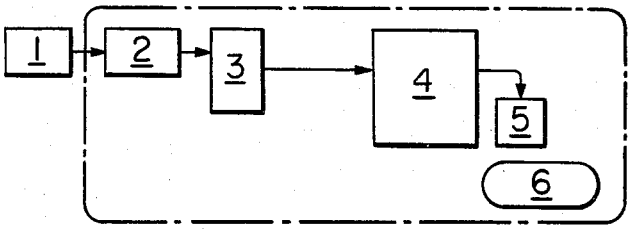
FIG. 1 and FIG. 2 are schematic illustrations of an electric charge controlling device according to the present invention.

Referring now to FIG. 1, wherein numeral 1 denotes an indication or indicator such as bar codes for indicating the most suitable condition for electric charging of a photosensitive member 6. In practice, the indication 1 is preferably provided on the member 6, although in this drawing, it is shown separately therefrom. 2 designates a sensor for reading the indication 1, which readings are deciphered by a decoder 3. Hence, the decoder 3 produces output signals. The bar codes mentioned above may be the optically readable ones having an intermittently shading bar in black and white, or colored, or having light and shade areas, and may also be formed by an electric conductor and an electric insulator so that the readings can be taken by a magnetically readable magnetic tape or a current collecting brush.

The signal output from the decoder 3 is connected directly to an electric power source 4 by a suitable connecting circuit, and the voltage or current of the electric power source 4 is adjusted to the electric charging condition which is instructed by the signal output from the decoder 3. A preferred circuit for a purpose described above will be mentioned later on.

Thereby the automatic control of an electric charging potential generated by the electric charging device 5, per se well known, for a photosensitive substance to be used becomes possible, and also good image reproductivity as well as ease of maintenance, efficiency etc. can be greatly improved.

Figure 2:
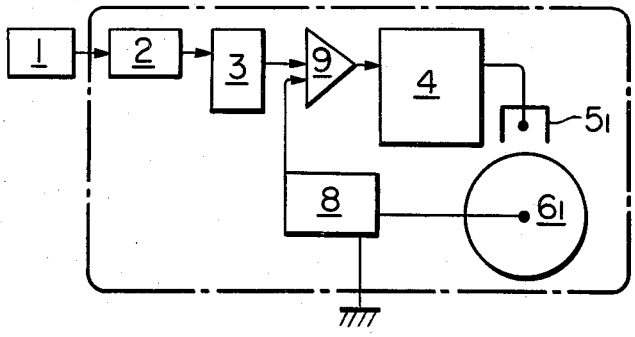

FIG. 2 shows the second example.

In this example of copying apparatus, the most suitable conditions for electrically charging a drum type photosensitive member, $6_1$ (referred to as photosensitive drum), which are recorded on a code 1, can be utilized as signal output by way of a decoder 3 through a sensor 2. On the other hand, the surface electric potential of the photosensitive drum $6_1$ can be utilized as signal output from a detector 8 which is connected or related to the photosensitive drum.

These two signal outputs are fed to a differential amplifier 9, which is capable of regulating the value of an electric current and/or electric voltage of a power source 4 so as to come to adjust to suitable electric charging condition for the photosensitive drum to be used. Through the power source which is controlled as mentioned above, corona charging device $5_1$ is operated, thereby the surface of the photoconductive drum $6_1$ is given suitable electric potential.

Figure 4:
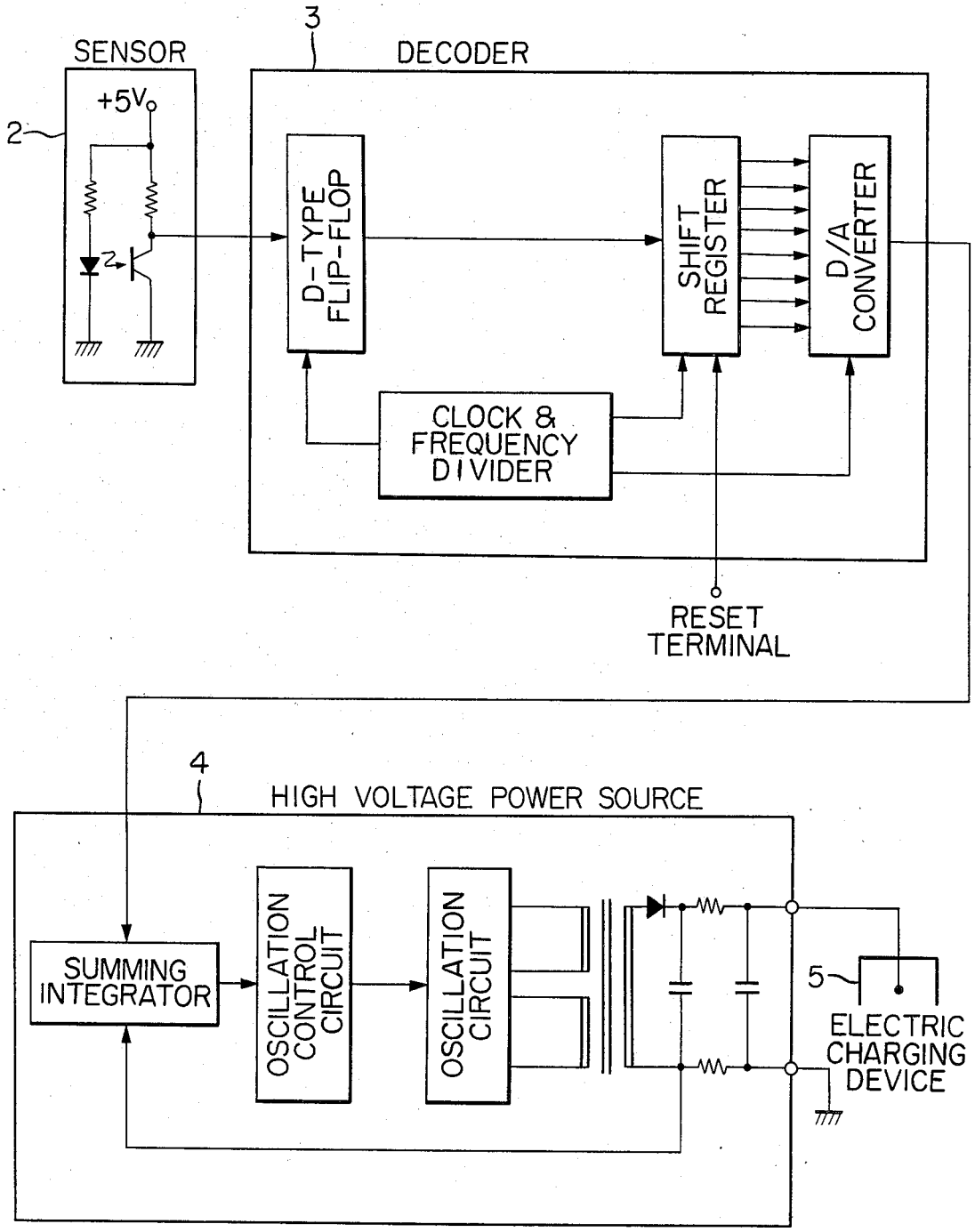
FIG. 4 is also a schematic illustration of an electric charge controlling device according to the present invention.
Figure 5:
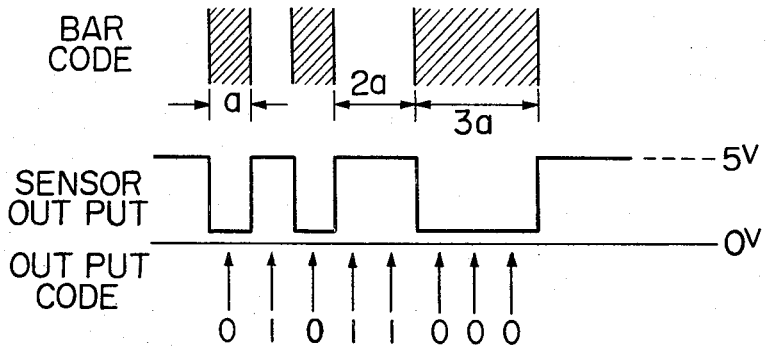
FIG. 5 is an illustration showing the relation between bar code and sensor output.
Figure 6:
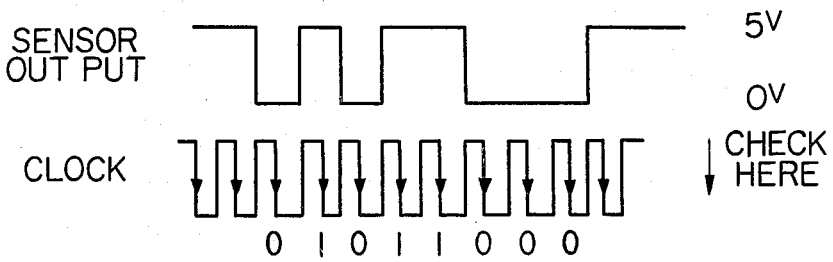
FIG. 6 is an illustration showing the timing to check the sensor output.

The detector 8 may be changed to the one whose system is responsive to the electric discharge values of an electric charging device $5_1$. Then, by making use of FIG. 4–FIG. 8, the manner in which the output signal from the decoder automatically changes the electric potential applied to the charging device shall be explained. FIG. 4 shows an electric charge controlling device. In FIG. 4, a photosensor is used as a sensor 2. Therefore the bar code consists of combination of white lines and black lines. The photosensor consists of a light emitting diode and a photo receiving member to receive the reflected light from the bar code. FIG. 5 shows the relation between the bar code and the sensor output. The code decoder changes the serial output from the photosensor into a collected signal (in the case of the code shown in FIG. 5 it is 8-bit parallel output). Further the decoder changes the collected signal into an analogue output of 0–5 V by D/A converter. D-type flip-flop divides the output from the sensor into the unit of length (or time) a and checks the output after every unit a as shown in FIG. 6. The flip-flop produces an output code by generating 1 for the output of 5 V from the sensor or 0 for the output of 0 V from the sensor. The unit a is generated by the clock and frequency divider. A shift register memorizes each code 0 or 1 in sequence and produces 8 bit signal by collecting 8 codes that change in accordance with time.

Figure 7:
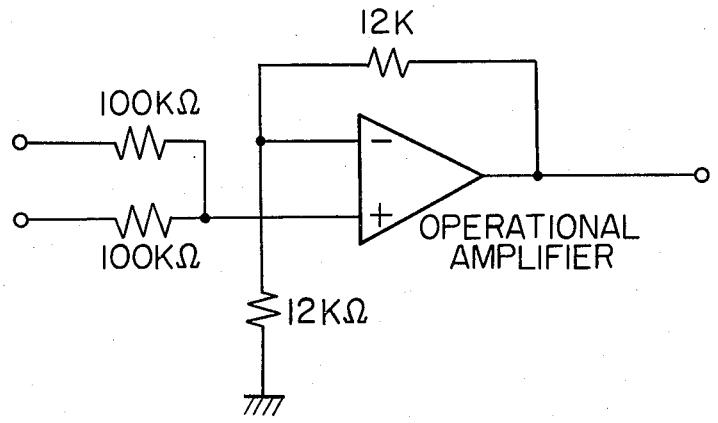
FIG. 7 is an illustration of summing integrator.
Figure 8:
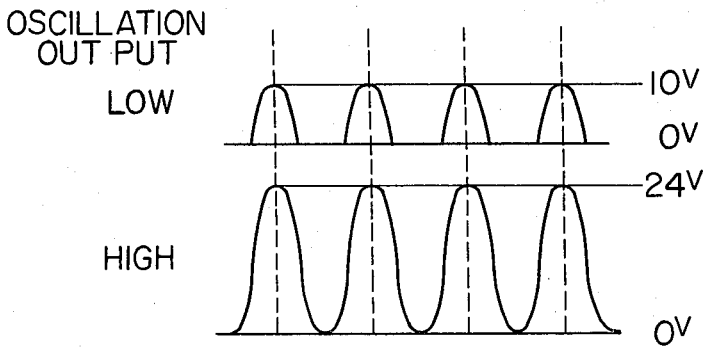
FIG. 8 is an illustration showing two forms of oscillation.

The analogue signal from the code decoder (0–5 V) is connected to a high voltage power source and enters a control circuit to control a oscillating circuit for generating a high voltage, and controls the intensity of the oscillation. Controlled oscillation output produces its voltage by high voltage transducer and is then rectified. Thus a high voltage output is generated. FIG. 7 shows a summing integrator. The summing integrator is a circuit to add a feed back signal for stabilizing the high voltage output to aforesaid control signal. By the summing integrator, the control and stabilization of high voltage output as shown in FIG. 8 is accomplished. The oscillation control circuit decides the threshold for oscillation and thus can change the oscillating form. High voltage transducer increases the voltage of aforesaid alternating current by 300–400 times.

By making use of this type of copying apparatus, the surface electric potential of the photosensitive drum 61 can always be maintained full-automatically to satisfy the most suitable conditions for electrically charging the photosensitive drum 61 in spite of any conditions, and it can produce copies having a good reproductivity and proper image density, continuously and without keeping an operator busy for adjustments.

Figure 3:
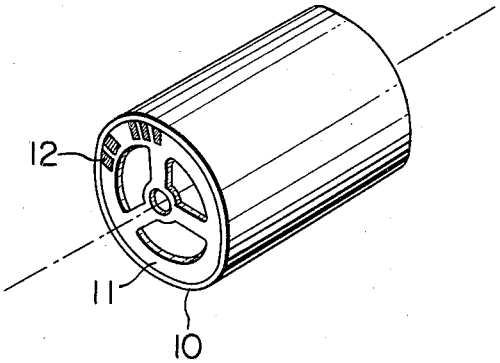
FIG. 3 is a perspective illustration showing the indication or indicator for electric charge control that is appended to a photosensitive member.

FIG. 3 illustrates one example by which code 1 is attached to a photosensitive drum and/or an appendant member of the photosensitive drum, in which said code 1 represents the most suitable conditions for electrically charging a photosensitive drum which is to be loaded in the copying apparatus described in the aforesaid examples first and second.

In this example bar code 12 having recorded the most suitable conditions for electrically charging photoconductive layer 10 such as Se mounted on the surface of the drum, is optically placed on an appendant member or frame 11 of the photosensitive drum, as in form of the intermittent row in black and white.

If a code described in a series of the aforementioned examples is appended to a photosensitive substance and/or an appendant member of photosensitive substance, an operator will be saved the trouble of referring to codes and will avoid the misreading of codes; in addition if all the items such as sensor, decoder, differential amplifier and detector are built into the main frame of a copying apparatus, copying can be made conveniently and easily.

What is claimed is:

1. In a copying apparatus in which an electrostatic latent image is formed on a photosensitive member on whose surface an electric potential has been generated, the improvement comprising means applying an electric charge to the surface of the photosensitive member, means forming an indicia on said member representing the optimum charging potential characteristics of the photosensitive substance on said member, and means controlling said electric charge in accordance with said indicia.

2. Copying apparatus according to claim 1, in which said indicia are in the form of a readable code, and in which said last means includes a sensor responsive to said code.

3. Copying apparatus according to claim 2, in combination with means measuring the actual charging potential in the photosensitive member, means comparing said actual charging potential with the optimum charging potential represented by the output of said sensor, and in which the means controlling said electric charge includes means responsive to said comparing means.

* * * * *